US007734207B2

(12) United States Patent
Condello et al.

(10) Patent No.: US 7,734,207 B2
(45) Date of Patent: Jun. 8, 2010

(54) TURRET FUSING APPARATUS

(75) Inventors: Anthony S Condello, Webster, NY (US); Donald M Bott, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 454 days.

(21) Appl. No.: 11/768,253

(22) Filed: Jun. 26, 2007

(65) Prior Publication Data

US 2009/0003899 A1 Jan. 1, 2009

(51) Int. Cl.
*G03G 15/20* (2006.01)

(52) U.S. Cl. ..... 399/66; 399/44; 399/328; 399/329

(58) Field of Classification Search ..... 399/321, 399/328, 329, 330, 331, 44, 66
See application file for complete search history.

(56) References Cited

U.S. PATENT DOCUMENTS 5,998,761 A 12/1999 Berkes et al.
6,196,675 B1 3/2001 Deily et al.
6,687,468 B2 2/2004 Holubek et al.
6,782,233 B2 8/2004 Condello et al.
2004/0037595 A1 * 2/2004 Takashi et al. ..... 399/307
2007/0041758 A1 * 2/2007 Condello et al. ..... 399/328

FOREIGN PATENT DOCUMENTS

JP 54095246 A * 7/1979

OTHER PUBLICATIONS

English translation of JP 54095246.*

* cited by examiner

*Primary Examiner*—David M Gray
*Assistant Examiner*—Barnabas T Fekete
(74) *Attorney, Agent, or Firm*—Prass LLP

(57) ABSTRACT

A turret fusing apparatus including (a) a frame; (b) a rotatable external pressure roller mounted at a first mounting position to the frame; and (c) a rotatable turret assembly mounted at a second mounting position on the frame for selectably forming different fusing nips having different characteristics with the rotatable external pressure roller. The rotatable turret assembly has at least a pair of internal pressure rollers including a first rotatable internal pressure roller for forming a first fusing nip having a first set of characteristics with the rotatable external pressure roller, and a second rotatable internal pressure roller for forming a second fusing nip having a second set of characteristics with the rotatable external pressure roller.

17 Claims, 3 Drawing Sheets

TURRET FUSING APPARATUS

Figure 1:
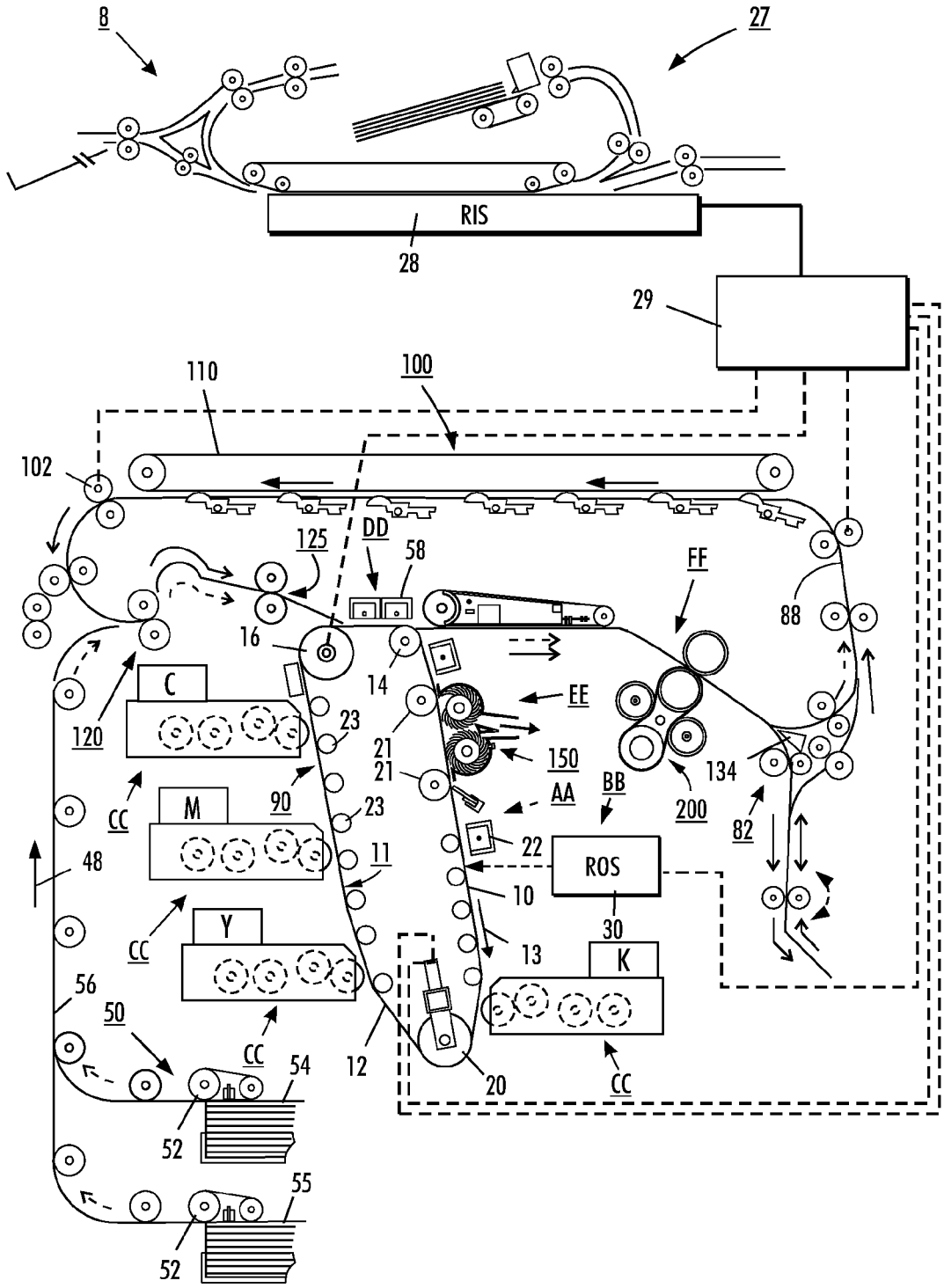

The present invention relates to electrostatographic image producing machines and, more particularly, to such a machine including a turret fusing apparatus.

One type of electrostatographic reproducing machine is a xerographic copier or printer. In a typical xerographic copier or printer, a photoreceptor surface, for example that of a drum, is generally arranged to move in an endless path through the various processing stations of the xerographic process. As in most xerographic machines, a light image of an original document is projected or scanned onto a uniformly charged surface of a photoreceptor to form an electrostatic latent image thereon. Thereafter, the latent image is developed with an oppositely charged powdered developing material called toner to form a toner image corresponding to the latent image on the photoreceptor surface. When the photoreceptor surface is reusable, the toner image is then electrostatically transferred to a recording medium, such as a sheet of paper, and the surface of the photoreceptor is cleaned and prepared to be used once again for the reproduction of a copy of an original. The sheet of paper with the powdered toner thereon in imagewise configuration is separated from the photoreceptor and moved through a fusing apparatus including a heated fusing member where the toner image thereon is heated and permanently fixed or fused to the sheet of paper.

In order to obtain quality fused images consistently on various types of sheets of paper and under various conditions, fusing apparatus in such machines typically present many challenges. Examples of prior efforts to deal with such challenges include U.S. Pat. No. 6,782,233 issued Aug. 24, 2004 to Condello et al. and entitled "Externally heated thick belt fuser" discloses heat and pressure belt fuser structure having an endless belt and a pair of pressure engageable members between which the endless belt is sandwiched for forming a fusing nip through which substrates carrying toner images pass with the toner images contacting an outer surface of the endless belt, at least one of the pressure engageable members has a deformable layer, and the endless belt has a thickness of from about 1 to about 8 mm; and the fuser structure includes an external source of thermal energy for elevating a pre-nip area of the belt. The thick belt in combination with a deformable layer of at least one of the pressure member(s) cooperate to provide a large nip and adequate creep for intrinsic paper stripping.

U.S. Pat. No. 6,687,468 issued Feb. 3, 2004 to Holubek et al. and entitled "Multi-position fuser nip cam" discloses a roll fusing apparatus for effectively heating and fusing quality toner images on various different thicknesses of substrates is described. The apparatus includes a frame, a heated fuser roller having a first end and a second end respectively mounted to the frame; a pressure device mounted to the frame and forming a fusing nip with the heated fuser roller, the heated fuser roller and the pressure device being movable for receiving, heating and applying a nip force to toner images being moved through the fusing nip on various different thicknesses of substrates; a rotatable cam providing a varying amount of pressure to the pressure device in response to the thickness of the substrate being fed into the nip of the fusing apparatus; a drive shaft for rotating the cam; and a controller for selectively moving the cam in response to the thickness of the substrate.

U.S. Pat. No. 6,196,675 issued Mar. 6, 2001 to Deily et al. and entitled "Apparatus and method for image fusing" discloses an apparatus and related method for improved image fusing in an ink jet printing system are provided. An ink image is transferred to a final receiving substrate by passing the substrate through a transfer nip. The substrate and ink image are then passed through a fusing nip that fuses the ink image into the final receiving substrate. Utilizing separate image transfer and image fusing operations allows improved image fusing and faster print speeds. The secondary fusing operation enables the image transfer process to use reduced pressures, whereby the load on the drum and transfer roller is reduced. Additionally, the secondary fusing operation may be utilized to apply a supplemental coating to the transferred image.

U.S. Pat. No. 5,998,761 issued Dec. 7, 1999 to Berkes et al. and entitled "Variable dwell fuser" discloses a variable dwell heat and pressure belt fuser for imparting selectable gloss to color toner images. A hybrid belt/roll fuser which has both a roll/roll nip and a belt/roll nip where the size of the latter can be varied by adjusting the position of the fuser roll around the axis of the pressure roll or by varying the location of the belt transport idler roll relative to the heat and pressure fuser members. For any given speed and nip pressure, the high pressure dwell between the fuser and pressure rolls is fixed but the low pressure dwell between the fuser roll and fuser belt can be varied from zero to four (or more) times the high pressure dwell in a prescribed manner.

Current high speed printing machines are rated around 110 ppm while near future printing machines are planned at greater than 135 ppm. Presently at the 110 ppm speed, conventional fusing apparatus are struggling to meet fix and gloss specifications for all rated types of print media. Specifically, conventional fusing apparatus have been found to have difficulty fusing some heavy-weight coated stocks, as well as difficulty stripping light weight papers. Currently, conventional fusing apparatus represent as much as 50% of the total run cost of a printing machine due to frequent replacements of fusing members which typically have multiple failure modes. It is easy to understand therefore that planned increased printing speeds of 135 ppm or greater will most definitely severely limit the latitude of conventional fusing apparatus.

There is therefore a need for a novel fusing apparatus that both enables higher printing speeds without struggling to meet fix and gloss specifications for all rated types of print media, and that significantly reduces run costs.

In accordance with the present disclosure, there is provided a turret fusing apparatus including (a) a frame; (b) a rotatable external pressure roller mounted at a first mounting position to the frame; and (c) a rotatable turret assembly mounted at a second mounting position on the frame for selectably forming different fusing nips having different characteristics with the rotatable external pressure roller. The rotatable turret assembly has at least a pair of internal pressure rollers including a first rotatable internal pressure roller for forming a first fusing nip having a first set of characteristics with the rotatable external pressure roller, and a second rotatable internal pressure roller for forming a second fusing nip having a second set of characteristics with the rotatable external pressure roller.

Figure 2:
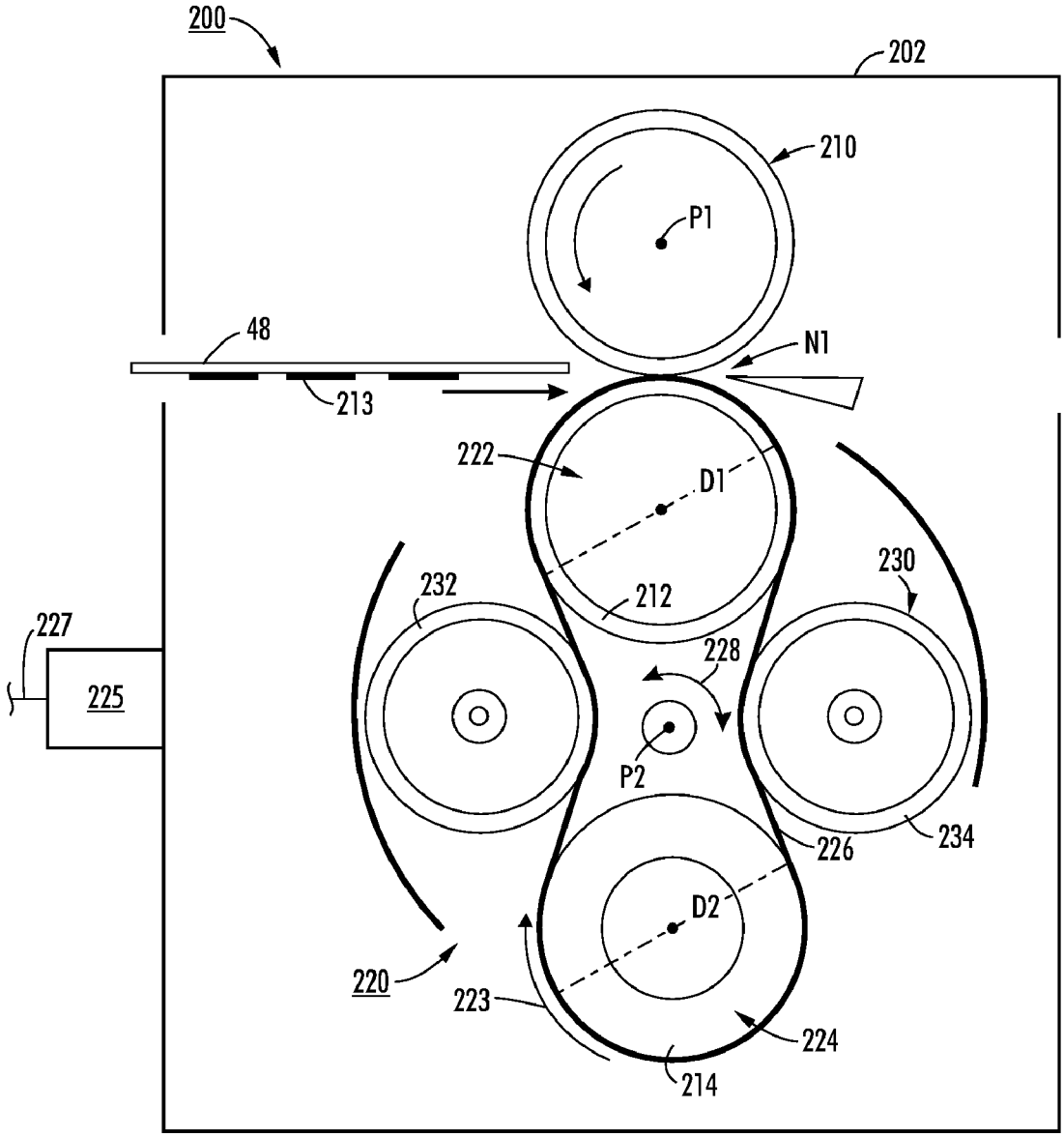
Figure 3:
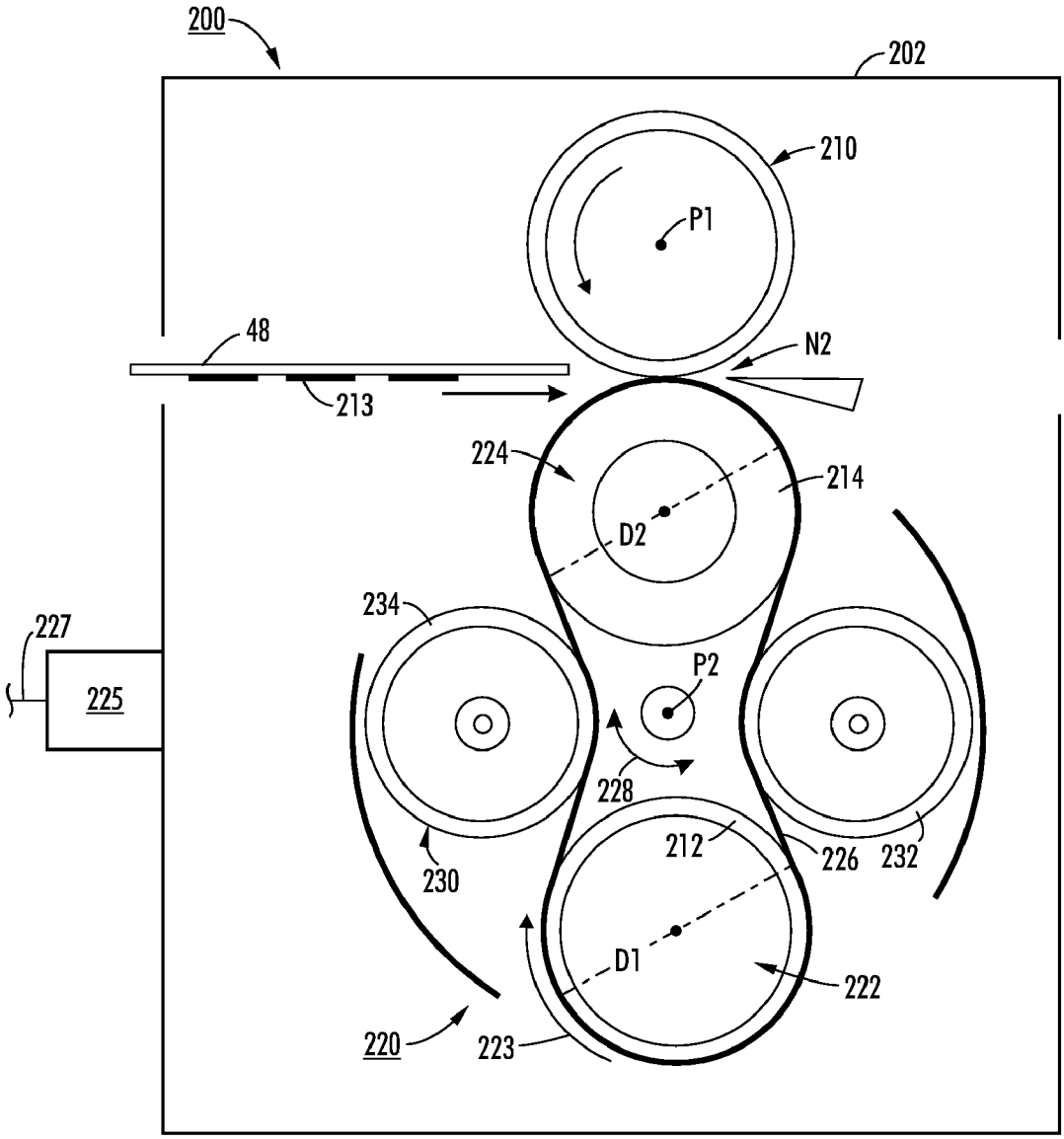

FIG. 1 is a schematic elevational view of an exemplary electrostatographic reproduction machine including a turret fusing apparatus in accordance with the present disclosure;

FIG. 2 is an enlarged end section schematic of the turret fusing apparatus of FIG. 1 showing the turret assembly forming a first fusing nip N1 having a first set of characteristics; and FIG. 3 is an enlarged end section schematic of the turret fusing apparatus of FIG. 1 showing the turret assembly forming a second fusing nip N2 having a second set of characteristics in accordance with the present disclosure.

Referring first to FIG. 1, it schematically illustrates an electrostatographic reproduction machine 8 that generally employs a photoconductive belt 10 mounted on a belt support module 90. Preferably, the photoconductive belt 10 is made from a photoconductive material coated on a conductive grounding layer that, in turn, is coated on an anti-curl backing layer. Belt 10 moves in the direction of arrow 13 to advance successive portions sequentially through various processing stations disposed about the path of movement thereof. Belt 10 is entrained as a closed loop 11 about stripping roll 14, drive roll 16, idler roll 21, and backer rolls 23.

Initially, a portion of the photoconductive belt surface passes through charging station AA. At charging station AA, a corona-generating device indicated generally by the reference numeral 22 charges the photoconductive belt 10 to a relatively high, substantially uniform potential.

As also shown the reproduction machine 8 includes a controller or electronic control subsystem (ESS) 29 that is preferably a self-contained, dedicated minicomputer having a central processor unit (CPU), electronic storage, and a display or user interface (UI). The ESS 29, with the help of sensors and connections, can read, capture, prepare and process image data and machine status information.

Still referring to FIG. 1, at an exposure station BB, the controller or electronic subsystem (ESS), 29, receives the image signals from RIS 28 representing the desired output image and processes these signals to convert them to a continuous tone or gray scale rendition of the image that is transmitted to a modulated output generator, for example the raster output scanner (ROS), indicated generally by reference numeral 30. The image signals transmitted to ESS 29 may originate from RIS 28 as described above or from a computer, thereby enabling the electrostatographic reproduction machine 8 to serve as a remotely located printer for one or more computers. Alternatively, the printer may serve as a dedicated printer for a high-speed computer. The signals from ESS 29, corresponding to the continuous tone image desired to be reproduced by the reproduction machine, are transmitted to ROS 30.

ROS 30 includes a laser with rotating polygon mirror blocks. Preferably a nine-facet polygon is used. At exposure station BB, the ROS 30 illuminates the charged portion on the surface of photoconductive belt 10 at a resolution of about 300 or more pixels per inch. The ROS will expose the photoconductive belt 10 to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image through development stations CC, that include four developer units as shown, containing CMYK color toners, in the form of dry particles. At each developer unit the toner particles are appropriately attracted electrostatically to the latent image using commonly known techniques.

With continued reference to FIG. 1, after the electrostatic latent image is developed, the toner powder image present on belt 10 advances to transfer station DD. A print sheet 48 is advanced to the transfer station DD, by a sheet feeding apparatus 50. Sheet-feeding apparatus 50 may include a corrugated vacuum feeder (TCVF) assembly 52 for contacting the uppermost sheet of stack 54, 55. TCVF 52 acquires each top sheet 48 and advances it to vertical transport 56. Vertical transport 56 directs the advancing sheet 48 through feed rolls 120 into registration transport 125, then into image transfer station DD to receive an image from photoreceptor belt 10 in a timed. Transfer station DD typically includes a corona-generating device 58 that sprays ions onto the backside of sheet 48. This assists in attracting the toner powder image from photoconductive surface 12 to sheet 48. After transfer, sheet 48 continues to move in the direction of arrow 60 where it is picked up by a pre-fuser transport assembly and forwarded to fusing station FF.

Fusing station FF includes the turret fusing apparatus 200 of the present disclosure (to be described in detail below) for fusing and permanently affixing the transferred toner powder image 213 to the copy sheet 48. The turret fusing apparatus 200 is a dynamically reconfigurable fusing nip high speed color belt fusing apparatus that enables reliable use of vastly different types of print media at full productivity with relatively short transition times from one nip configuration to the next, resulting in higher productivity, increased reliability and lower run costs.

After that, the sheet 48 then passes to a gate 88 that either allows the sheet to move directly via output 17 to a finisher or stacker, or deflects the sheet into the duplex path 100. Specifically, the sheet (when to be directed into the duplex path 100), is first passed through a gate 134 into a single sheet inverter 82. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 100, where that sheet will be inverted and then fed to acceleration nip 102 and belt transports 110, for recirculation back through transfer station DD and fuser 70 for receiving and permanently fixing the side two image to the backside of that duplex sheet, before it exits via exit path 17.

After the print sheet is separated from photoconductive surface 12 of belt 10, the residual toner/developer and paper fiber particles still on and may be adhering to photoconductive surface 12 are then removed there from by a cleaning apparatus 150 at cleaning station EE.

Referring now to FIGS. 1-3, the turret fusing apparatus 200 includes (a) a frame 202; (b) a rotatable external pressure roller 210 mounted at a first mounting position P1 to the frame; and (c) a rotatable turret assembly 220 that is mounted at a second mounting position P2 on the frame for selectably forming different fusing nips N1, N2 (having different characteristics) with the rotatable external pressure roller 210. The rotatable turret assembly 220 as shown is pivotable about the position P2, and has at least a pair of internal pressure rollers 222, 224 including a first rotatable internal pressure roller 222 for forming a first fusing nip N1 (having a first set of characteristics) with the rotatable external pressure roller 210, and a second rotatable internal pressure roller 224 for forming a second fusing nip N2 (having a second set of characteristics) with the rotatable external pressure roller 210. The rotatable turret assembly includes moving means 225 that are coupled at 227 to the controller or ESS 29, and is controllably rotatable at least 180 degrees about the second mounting position P2.

As further illustrated, the turret fusing apparatus 200 includes a movable endless fusing belt 226 that is mounted over the at least a pair of internal pressure rollers 222, 224 and is movable in the direction 223 through the fusing nip N1, N2. It also includes a heating assembly 230 for heating the movable endless fusing belt 226. The heating assembly 230 comprises at least one external heating roller 232, 234 in contact with the movable endless fusing belt. In the case where only one heating roller 232, 234 is used, the turret fusing apparatus 200 will include a non-heating tracking roller (not shown)

opposite the one heating roller 232, 234. In one embodiment as shown, the heating assembly 230 comprises a pair of external heating rollers 232, 234 with each being mounted in tracking contact with the movable endless fusing belt 226. It should be understood that any suitable heating combination, including any and all rollers in the turret assembly, can be used to heat the fusing belt 226. In each case, the heating assembly 230 will be suitable for heating the fusing belt 226 to a temperature that is sufficient to melt and fuse toner images 213 on a print media being moved through the fusing nip N1, N2.

The first rotatable internal pressure roller includes a first elastomeric layer that is relatively thinner than a similar elastomeric layer on the second rotatable internal pressure roller so as to be suitable for satisfactorily fusing toner images on relatively thin and light weight print media. The second rotatable internal pressure roller includes a second elastomeric layer that is relatively thicker than a similar elastomeric layer on the first rotatable internal pressure roller so as to be suitable for satisfactorily fusing toner images on relatively thick and heavy weight print media. The first rotatable internal pressure roller includes an elastomeric layer having a hardness of about 60 ShA so as to be suitable for satisfactorily fusing toner images on relatively thin and light weight print media. The second rotatable internal pressure roller includes an elastomeric layer having a hardness within a range of about 35-40 ShA so as to be suitable for satisfactorily fusing toner images on relatively thick and heavy weight print media.

The first rotatable internal pressure roller includes an elastomeric layer having a thickness of about 5 mm so as to be suitable for satisfactorily fusing toner images on relatively thin and light weight print media. The second rotatable internal pressure roller includes an elastomeric layer having a thickness of about 15 mm so as to be suitable for satisfactorily fusing toner images on relatively thick and heavy weight print media. The second rotatable internal pressure roller has an external diameter that is relatively greater than an external diameter of the first rotatable internal pressure roller so as to be suitable for satisfactorily fusing toner images on relatively thick and heavy weight print media.

In accordance with the present disclosure, there has been provided a dynamically reconfigurable fusing nip belt fusing apparatus 200 that includes a frame 202, an external pressure roller 210 and a movable turret assembly 220 comprising a fusing belt 226 and first and second media-optimized internal pressure rollers 222, 224 for each selectably forming a desired reconfigurable fusing nip N1, N2 with the external pressure roller 210. Since the internal pressure rollers 222, 224 are each optimized for different types of print media, (if it were known that only light weight or only heavy weight papers or print media were to be used on a particular machine or in a given large printing job), the fusing nip N1, N2 would be configured using the particular internal pressure roller 222, 224 (that is optimized for such media) to form the fusing nip with the external pressure roller 210.

The first internal pressure roll 222 is optimized for fusing thin and light weight print media as well as for good stripping, and as such has a thinner and/or harder elastomeric layer 214 that forms a relatively smaller fusing nip N1 and is thus optimal for fix, gloss and stripping performance. As shown in FIG. 2, the thinner and/or harder elastomeric layer 212 is approximately 5 mm thick and has a diameter D1 and a hardness of about 60 ShA. This will enable about an 8% creep and create an 18 mm fusing nip width (for a 26 ms dwell time) which for most cases is adequate to fuse and strip light-weight papers at about 165 ppm printing machine speed.

The second internal pressure roll 224 is optimized robust fusing of thick and heavy weight print media, and as such has a thicker and/or softer elastomeric layer 214 for forming a relatively bigger fusing nip N2 (FIG. 3). The thick elastomeric layer 214 thereof can have thickness of as much as 15 mm and be extremely soft with 35-40 ShA rating. The second internal pressure roller 224 may also have a slightly larger diameter D2 of about 100 mm.

As shown, the first and second internal pressure rollers 222, 224 are mounted internally to the fusing belt 226, and rigidly to a movable frame 202 that can be selectably rotated (arrows 28) at least 180 degrees for repositioning either the first 222 or second 224 internal pressure roller to form the fusing nip N1, N2 with the external pressure roller 210. The selection of which internal pressure roller 222, 224 to form the fusing nip N1, N2 with the external pressure roller 210 is dependant on the expected material properties and thickness characteristics of the print media, and may also be a function of image density and image proximity to lead edge of the print media. Running or operating the fusing apparatus 200 in the heavy weight mode whenever possible will minimize belt creep and hence edge wear. For customers that use large amounts of heavy-weight, easy to strip and/or low area coverage images, edge wear life may be pushed out significantly.

The dynamically reconfigurable fusing nip belt fusing apparatus 200 includes one external pressure roller 210 mounted to the frame for forming each fusing nip N1, N2 with the fusing belt 226 and a selected internal pressure roller 222, 224. The dynamically reconfigurable fusing nip belt fusing apparatus 200 also includes a pair of external heated rollers 232, 234 (a first external heated roller 232 and a second external heated roller 234) for contacting and heating the fusing belt 226 to a temperature suitable for melting and fusing toner images 213 through the fusing nip N1, N2. Together, the first and second external heated rollers 232, 234 can also be used to actively track the fusing belt 226.

As can be seen, there has been provided a turret fusing apparatus including (a) a frame; (b) a rotatable external pressure roller mounted at a first mounting position to the frame; and (c) a rotatable turret assembly mounted at a second mounting position on the frame for selectably forming different fusing nips having different characteristics with the rotatable external pressure roller. The rotatable turret assembly has at least a pair of internal pressure rollers including a first rotatable internal pressure roller for forming a first fusing nip having a first set of characteristics with the rotatable external pressure roller, and a second rotatable internal pressure roller for forming a second fusing nip having a second set of characteristics with the rotatable external pressure roller.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A turret fusing apparatus comprising:

(a) a frame;

(b) a rotatable external pressure roller mounted at a first mounting position to said frame; and (c) a rotatable turret assembly mounted at a second mounting position on said frame for selectably forming different fusing nips having different characteristics with said rotatable external pressure roller, said rotatable turret assembly having at least a pair of internal pressure rollers including a first rotatable internal pressure roller for forming a first fusing nip having a first set of characteristics with said rotatable external pressure roller, and a second rotatable internal pressure roller for forming a second fusing nip having a second set of characteristics with said rotatable external pressure roller, and a movable endless fusing belt mounted over said at least a pair of internal pressure rollers.

2. The turret fusing apparatus of claim 1, including a heating assembly for heating said movable endless fusing belt.

3. The turret fusing apparatus of claim 1, wherein said turret assembly is rotatable at least 180 degrees about said second mounting position.

4. The turret fusing apparatus of claim 1, wherein said first rotatable internal pressure roller includes a first elastomeric layer that is relatively thinner than a similar elastomeric layer on said second rotatable internal pressure roller so as to be suitable for satisfactorily fusing toner images on relatively thin and light weight print media.

5. The turret fusing apparatus of claim 1, wherein said second rotatable internal pressure roller includes a second elastomeric layer that is relatively thicker than a similar elastomeric layer on said first rotatable internal pressure roller so as to be suitable for satisfactorily fusing toner images on relatively thick and heavy weight print media.

6. The turret fusing apparatus of claim 1, wherein said first rotatable internal pressure roller includes an elastomeric layer having a hardness of about 60 ShA so as to be suitable for satisfactorily fusing toner images on relatively thin and light weight print media.

7. The turret fusing apparatus of claim 1, wherein said second rotatable internal pressure roller includes an elastomeric layer having a hardness within a range of about 35-40 ShA so as to be suitable for satisfactorily fusing toner images on relatively thick and heavy weight print media.

8. The turret fusing apparatus of claim 1, wherein said first rotatable internal pressure roller includes an elastomeric layer having a thickness of about 5 mm so as to be suitable for satisfactorily fusing toner images on relatively thin and light weight print media.

9. The turret fusing apparatus of claim 1, wherein said second rotatable internal pressure roller includes an elastomeric layer having a thickness of about 15 mm so as to be suitable for satisfactorily fusing toner images on relatively thick and heavy weight print media.

10. The turret fusing apparatus of claim 1, wherein said second rotatable internal pressure roller has an external diameter that is relatively greater than an external diameter of said first rotatable internal pressure roller so as to be suitable for satisfactorily fusing toner images on relatively thick and heavy weight print media.

11. The turret fusing apparatus of claim 2, wherein said heating assembly comprises at least one external heating roller in contact with said movable endless fusing belt.

12. The turret fusing apparatus of claim 2, wherein said heating assembly comprises a pair of external heating rollers each mounted in tracking contact with said movable endless fusing belt.

13. A turret fusing apparatus comprising:

(a) a frame;

(b) a rotatable external pressure roller mounted at a first mounting position to said frame;

(c) a rotatable turret assembly mounted at a second mounting position on said frame for selectably forming different fusing nips having different characteristics with said rotatable external pressure roller, said rotatable turret assembly having at least a pair of internal pressure rollers including a first rotatable internal pressure roller for forming a first fusing nip with said rotatable external pressure roller, and a second rotatable internal pressure roller for forming a second fusing nip with said rotatable external pressure roller, and a movable endless fusing belt mounted over said at least a pair of internal pressure rollers;

(d) moving means connected to said rotatable turret assembly for moving said rotatable turret assembly; and (e) a programmable controller coupled to said moving means for controllably moving and positioning one of said first rotatable internal pressure roller and said second rotatable internal pressure roller in nip forming relation with said rotatable external pressure roller.

14. The turret fusing apparatus of claim 13, including a heating assembly for heating said movable endless fusing belt.

15. The turret fusing apparatus of claim 13, wherein said first rotatable internal pressure roller includes a first elastomeric layer that is relatively thinner than a similar elastomeric layer on said second rotatable internal pressure roller so as to be suitable for satisfactorily fusing toner images on relatively thin and light weight print media.

16. An electrostatographic reproduction machine comprising:

(a) a moveable imaging member including an imaging surface;

(b) imaging means for forming and transferring a toner image onto a toner image carrying sheet; and (c) a turret fusing apparatus including (i) a frame;

(ii) a rotatable external pressure roller mounted at a first mounting position to said frame; and (iii) a rotatable turret assembly mounted at a second mounting position on said frame for selectably forming different fusing nips having different characteristics with said rotatable external pressure roller, said rotatable turret assembly having at least a pair of internal pressure rollers including a first rotatable internal pressure roller for forming a first fusing nip having a first set of characteristics with said rotatable external pressure roller, and a second rotatable internal pressure roller for forming a second fusing nip having a second set of characteristics with said rotatable external pressure roller, and a movable endless fusing belt mounted over said at least a pair of internal pressure rollers.

17. The electrostatographic reproduction machine of claim 16, wherein said second rotatable internal pressure roller includes a second elastomeric layer that is relatively thicker than a similar elastomeric layer on said first rotatable internal pressure roller so as to be suitable for satisfactorily fusing toner images on relatively thick and heavy weight print media.

* * * * *